US010543955B1

(12) United States Patent
Turturro et al.

(10) Patent No.: US 10,543,955 B1
(45) Date of Patent: Jan. 28, 2020

(54) DISPENSER FOR EYE SHIELDS

(71) Applicant: Medline Industries, Inc., Northfield, IL (US)

(72) Inventors: Michael V. Turturro, Arlington Heights, IL (US); Allison Ward, Chicago, IL (US); David S. Noskowicz, Spring Grove, IL (US)

(73) Assignee: Medline Industries, Inc., Northfield, IL (US)

( * ) Notice: Subject to any disclaimer, the term of this patent is extended or adjusted under 35 U.S.C. 154(b) by 0 days.

(21) Appl. No.: 16/284,288

(22) Filed: Feb. 25, 2019

(51) Int. Cl.
*B65D 5/72* (2006.01)

(52) U.S. Cl.
CPC ..... *B65D 5/725* (2013.01)

(58) Field of Classification Search
CPC ..... A47F 1/08; A61F 9/028
See application file for complete search history.

(56) References Cited

U.S. PATENT DOCUMENTS 1,378,534 A * 5/1921 Fitz Gerald ..... A47F 1/08 229/122.1
1,412,547 A * 4/1922 Weymuth ..... A47F 1/08 229/122.1
1,898,056 A * 2/1933 Johnson ..... B65D 5/725 229/122.1
1,959,231 A * 5/1934 Dube ..... A24F 27/10 206/124
2,299,027 A * 10/1942 Novak ..... B65D 5/725 229/122.1
3,186,591 A * 6/1965 Solomon ..... B65D 5/724 221/260
3,265,283 A 8/1966 Farquhar
3,450,308 A * 6/1969 Schoenefeld ..... B65D 5/724 221/305
4,269,315 A 5/1981 Boyce
4,805,765 A 2/1989 Barrett
4,899,929 A * 2/1990 Grollman ..... B65D 5/36 221/302
5,249,737 A * 10/1993 Fritz ..... B65D 5/724 221/1
5,836,478 A * 11/1998 Weiss ..... B65D 5/725 221/309
6,062,424 A * 5/2000 Simile-Gravina ..... A47F 1/08 206/746
7,648,048 B2 1/2010 Smith
(Continued)

FOREIGN PATENT DOCUMENTS

JP 6247137 12/2017

*Primary Examiner* — Gene O Crawford
*Assistant Examiner* — Ayodeji T Ojofeitimi
(74) *Attorney, Agent, or Firm* — Fitch, Even, Tabin & Flannery, LLP

(57) ABSTRACT

Disclosed is an eye shield dispenser. The dispenser has a front panel, a rear panel, first and second front side panels, first and second rear side panels, a top panel, and a bottom panel. The front panel includes an access port providing access for removal of eye shields contained therein. An optional inclined surface is disposed in the interior of the dispenser near the access port, and eye shields are configured to be placed thereon and manually removed therefrom. The dispenser is shaped to generally correspond with the shape of the eye shields to hold the eye shields in place such that an inner insert is not required.

28 Claims, 14 Drawing Sheets

(56) References Cited

U.S. PATENT DOCUMENTS

| | | | | |
|---|---|---|---|---|
| 7,743,972 | B2 * | 6/2010 | Fogle | B65D 71/36 221/302 |
| 8,136,697 | B2 | 3/2012 | Hackney | |
| 9,586,749 | B2 | 3/2017 | Schultz | |
| 9,796,499 | B2 | 10/2017 | Schultz | |
| 10,065,762 | B2 | 9/2018 | Schultz | |
| 1,009,878 | A1 | 10/2018 | Umentum | |
| 2004/0094568 | A1 * | 5/2004 | Dailey, III | B65D 5/4204 221/303 |
| 2006/0027639 | A1 * | 2/2006 | Rasmussen | A47F 1/08 229/122.1 |
| 2006/0249529 | A1 * | 11/2006 | Smalley | B65D 5/725 221/305 |
| 2009/0272756 | A1 * | 11/2009 | Hackney | A47F 1/08 221/154 |
| 2012/0091163 | A1 * | 4/2012 | Lowry | A47F 1/082 221/1 |
| 2014/0319205 | A1 * | 10/2014 | Schultz | B65D 5/725 229/122.1 |
| 2015/0191296 | A1 * | 7/2015 | Umentum | B65D 83/0805 221/1 |
| 2015/0203282 | A1 | 7/2015 | Umentum | |
| 2018/0370680 | A1 | 12/2018 | Shultz et al. | |

* cited by examiner

DISPENSER FOR EYE SHIELDS

FIELD

The disclosure relates generally to the field of dispensers, and in certain embodiments relates to a dispenser used to contain and dispense eye shields.

BACKGROUND

Disposable eye shields are used in a variety of settings, including clinical and medical settings, to provide protection from particles that may cause damage to the eyes, such as splattering fluids. Such eye shields are typically packaged and dispensed from disposable containers, each container holding a quantity of eye shields that may be used and discarded thereafter.

In some dispensers for such eye shields, the eye shields may become disorganized within the dispenser and difficult to remove. Some known eye shield dispensers require an inner insert or column placed therein to hold the eye shields in place before they are dispensed. However, forming the inner insert requires additional material during manufacture, adds to the overall weight of the dispenser, and necessitates additional assembly.

Generally, it has now been found that an eye shield dispenser with panels shaped to substantially correspond with the shape of the eye shields and having an optional inclined surface for the eye shields to rest on before being dispensed provides a dispenser that does not require an additional inner insert to stack the eye shields and keep them substantially stationary within the dispenser.

DETAILED DESCRIPTION

In general, an eye shield dispenser having a front panel, a rear panel, first and second front side panels, first and second rear side panels, a top panel, and a bottom panel is provided. The front panel, rear panel, first and second front side panels, first and second rear side panels, top panel, and bottom panel are joined to provide an interior of the dispenser for accepting eye shields. The front panel includes an access port providing access for removal of eye shields contained therein. An optional inclined surface is disposed in the interior of the dispenser near the access port, and eye shields are configured to be placed thereon. The dispenser is shaped to generally correspond with the shape of the eye shields to hold the eye shields in place while stacked in the dispenser such that an inner insert is not required.

The dispenser may be formed of a foldable cardboard or cardstock material. The dispenser may be assembled at least in part using an adhesive such as glue, tape, or the like. Additionally, or alternatively, the panels of the dispenser may include interlocking tabs and flaps to maintain the assembly of the dispenser. The dispenser may, in some embodiments, be formed of a blank of foldable material. The blank of foldable material may be processed to include fold lines about which the panels may be folded to form the dispenser. The blank may be cut from a blank sheet of material such as cardboard or cardstock using conventional techniques to provide the fold lines. The dispenser may then be assembled and filled with eye shields.

Figure 1:
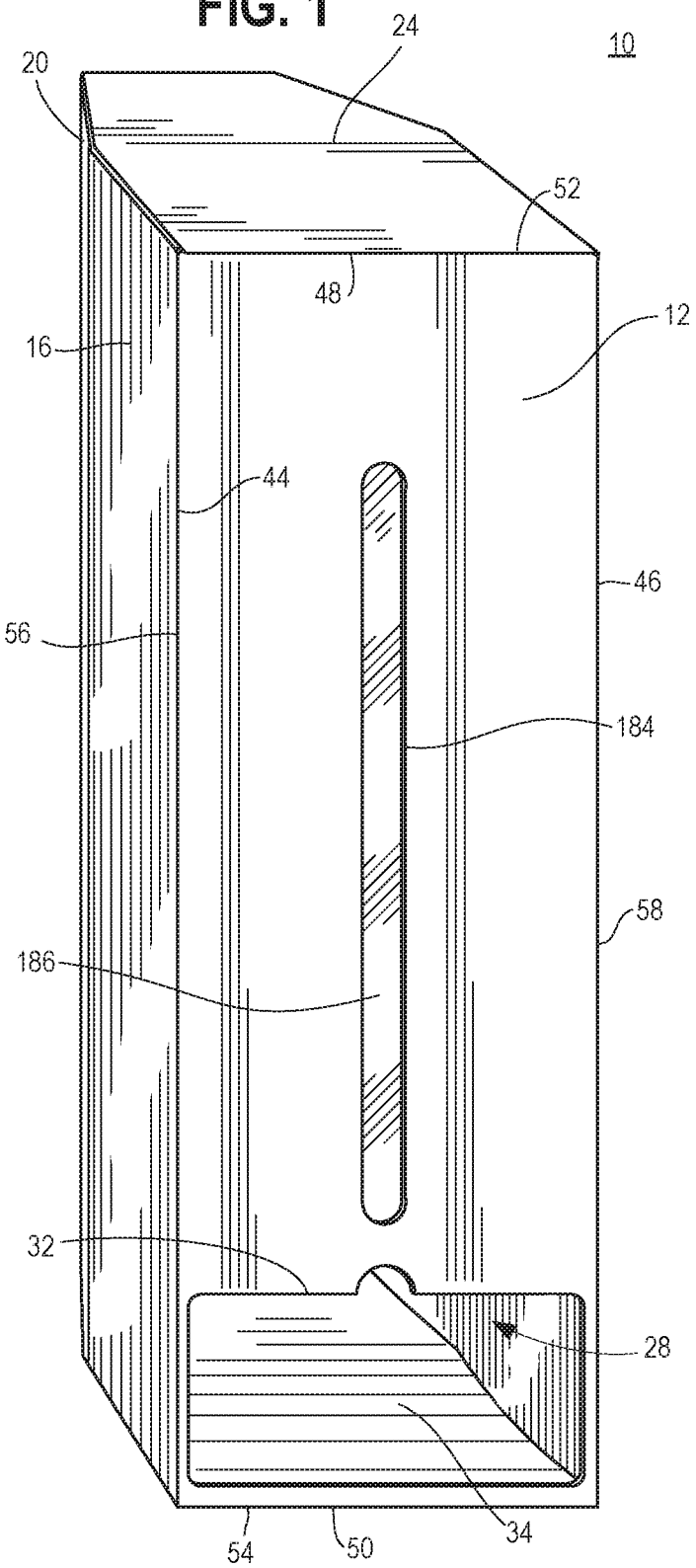
FIG. 1 is a perspective view of an eye shield dispenser in accordance with one embodiment.
Figure 2:
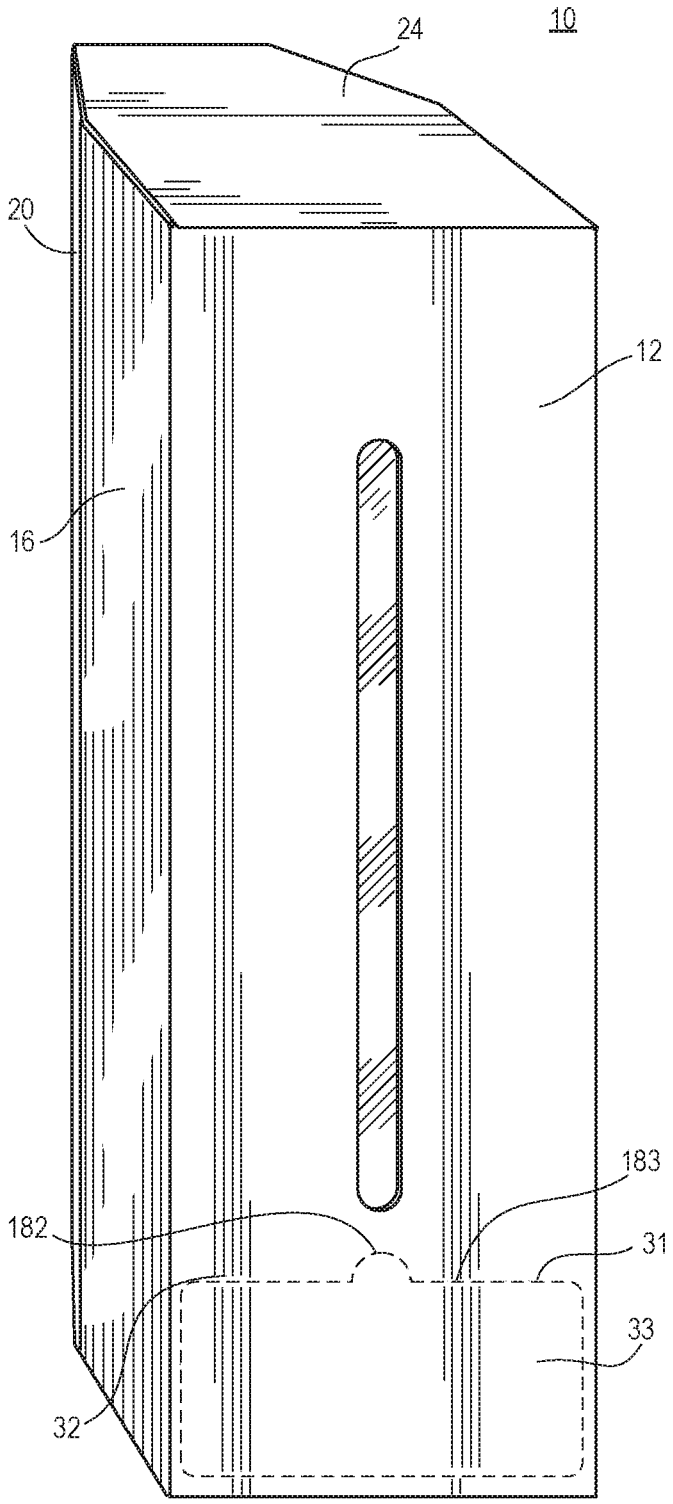
FIG. 2 is a perspective view of the eye shield dispenser of FIG. 1 having a removable access panel.

As depicted in FIG. 1, the illustrated eye shield dispenser 10 includes a front panel 12, a rear panel 14, a first front side panel 16, a second front side panel 18, a first rear side panel 20, a second rear side panel 22, a top panel 24 and a bottom panel 26 that are joined together to define an interior 28 of the dispenser 10 for containing at least one eye shield 30. In the exemplary embodiment, the front panel 12, rear panel 14, first front side panel 16, second front side panel 18, first rear side panel 20, second rear side panel 22, top panel 24 and bottom panel 26 are all formed of a single blank 100 of foldable material (FIG. 16), as described further hereinafter. The front panel 12 additionally includes an access port 32 to provide access to the interior 28 of the dispenser 10 to remove an eye shield 30 that may be stored therein. As shown in FIG. 2, the access port 32 may be a removable access panel 33 defined by perforations 31 of the front panel 12.

Figure 3:
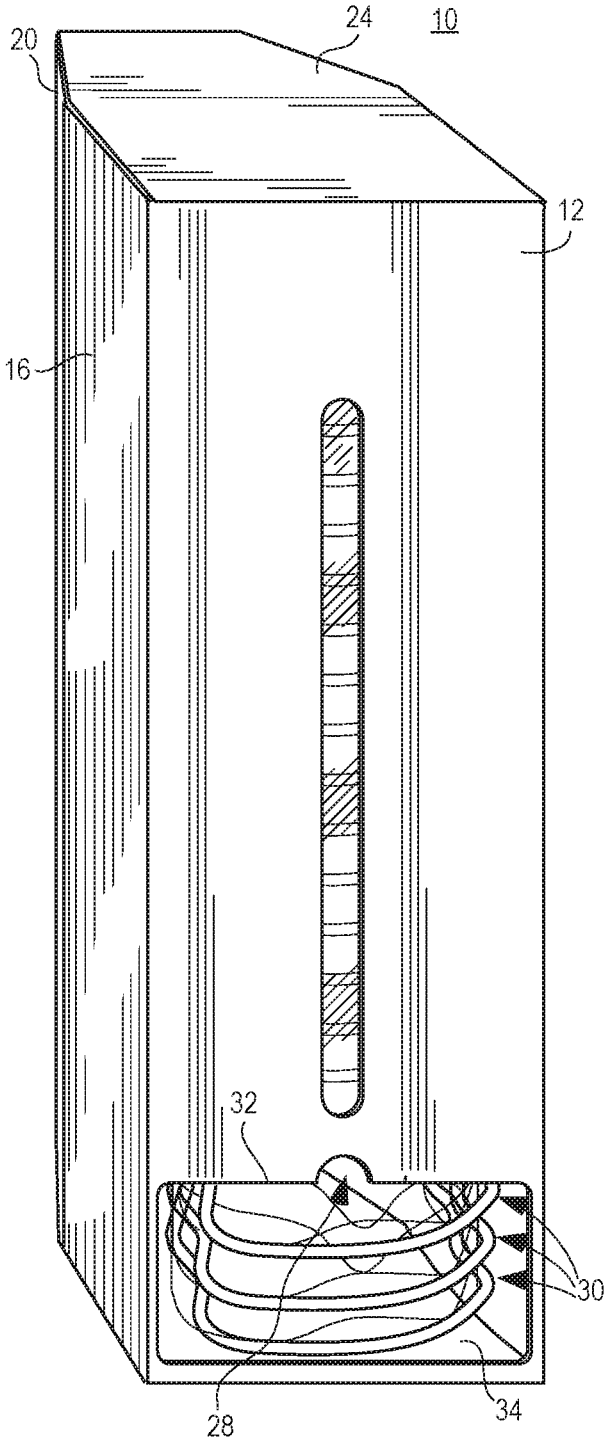
FIG. 3 is a perspective view of an eye shield dispenser shown in FIG. 1, illustrating a plurality of eye shields disposed within.
Figure 4:
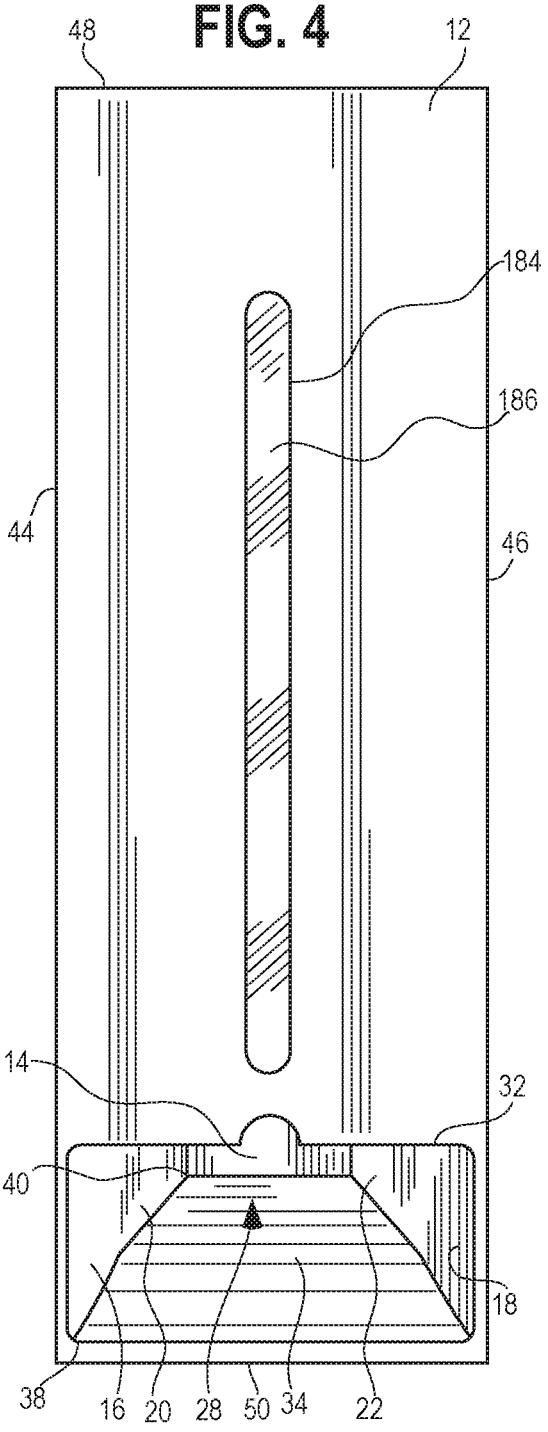
FIG. 4 is a front elevational view of the eye shield dispenser shown in FIG. 1.

As seen in FIGS. 3 and 4, the dispenser may optionally include an inclined surface 34 disposed in the interior 28 of the dispenser 10 on which eye shields 30 may be stacked. In embodiments including the inclined surface 34, the surface 34 extends from a first, lower height 38 near the front panel 12, to a second, higher height 40 near the rear panel 14. As shown in FIG. 3, and as further seen with reference to FIG.

Figure 17:
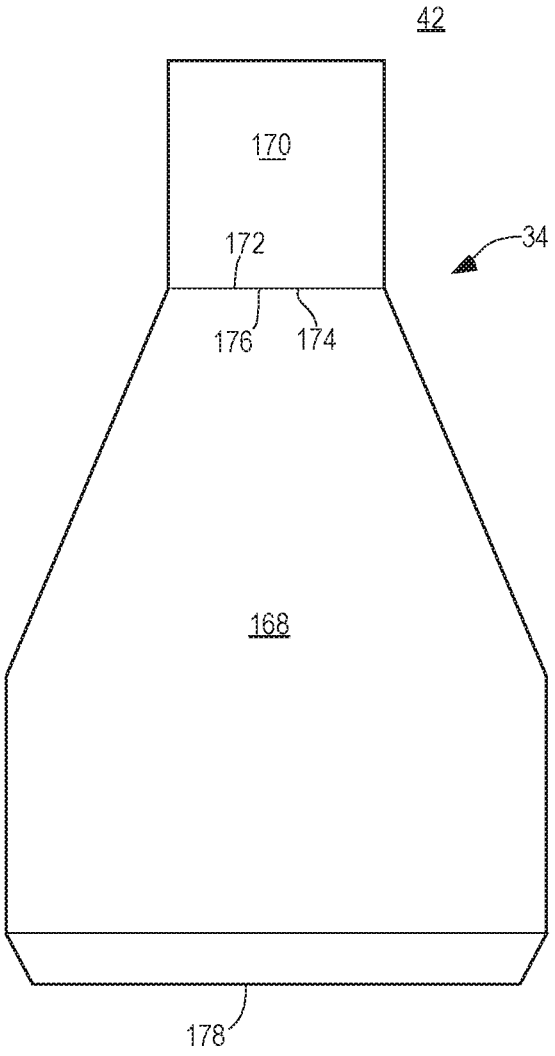
FIG. 17 is a plan view of a blank foldable to form the inclined surface panel shown in FIG. 14.
Figure 18:
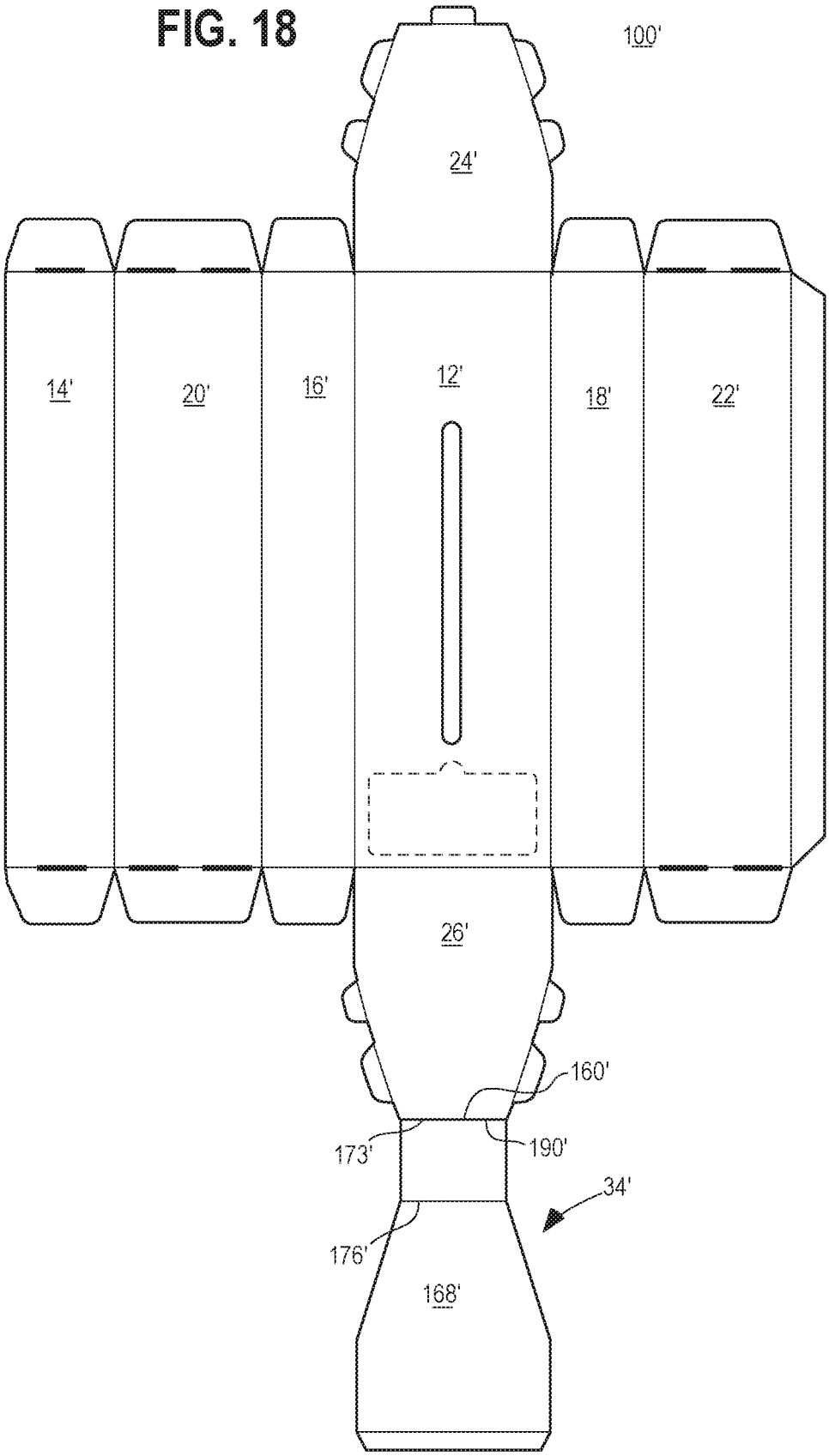
FIG. 18 is a plan view of a blank foldable to form into an eye shield dispenser including an integral inclined surface panel in accordance with another embodiment.
Figure 19:
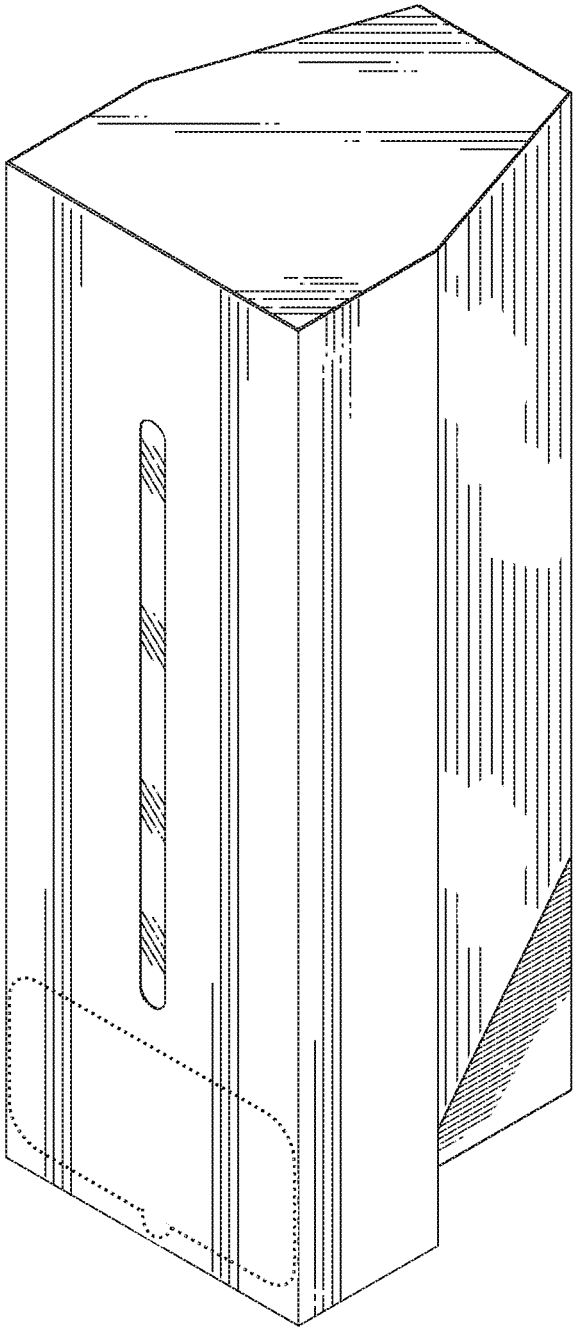
FIG. 19 is a front perspective view of an alternative eye shield dispenser.
Figure 20:
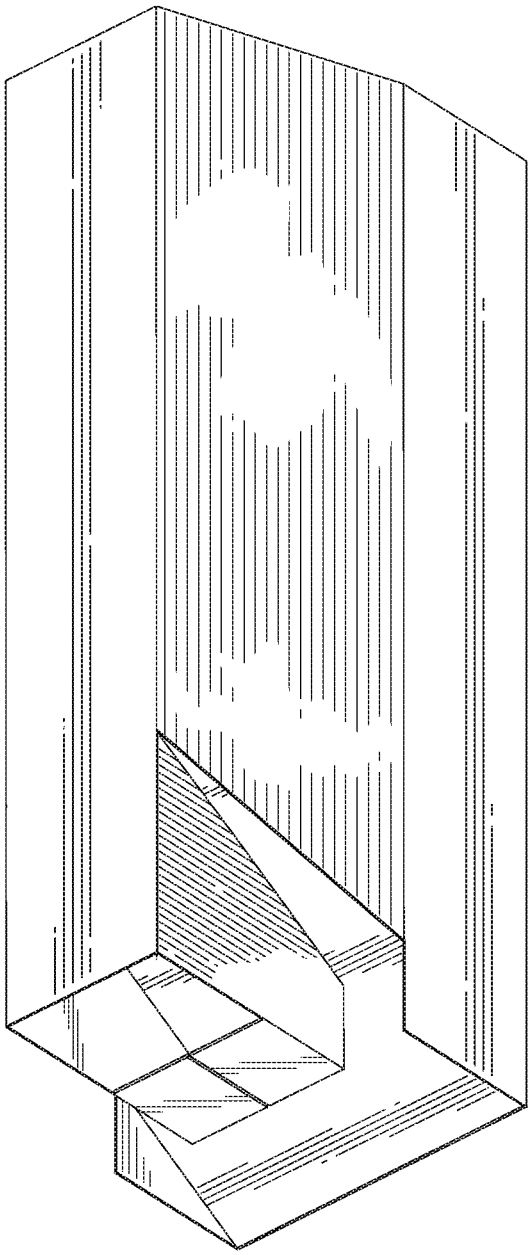
FIG. 20 is a rear perspective view of the eye shield dispenser shown in FIG. 19.

14, the inclined surface 34 allows vertically stacked eye shields 30 to be removed individually and to allow the subsequent shield to move to a dispensing position within the interior 28 of the dispenser 10. In the illustrated embodiment, the inclined surface 34 is formed of an optional, separate blank of material 42 as shown in FIG. 17 and attached after dispenser 10 has been formed via folding of the blank 100. Alternatively, the inclined surface 34 may be formed of, and integral with, the blank 100 to be folded to assemble the dispenser 10 such that only a single blank is needed, as shown in FIG. 18. In another alternative embodiment, the bottom panel may be folded from a single blank such that the bottom panel itself forms the inclined surface, as shown in FIGS. 19 and 20.

Returning to FIG. 1, the front panel 12 has a first side edge 44, a second side edge 46, a top edge 48, and a bottom edge 50. The front panel 12 is joined to the top panel 24 at the front panel top edge 48 along a first fold line 52 and joined to the bottom panel 26 at the front panel bottom edge 38 along a second fold line 54. The front panel 12 is joined to the first front side panel 16 at the front panel first side edge 44 along a third fold line 56 and the second front side panel 18 at the front panel second side edge 46 along a fourth fold line 58. This configuration is not critical and the panels may be joined to other panels at different fold lines in other embodiments.

Figure 5:
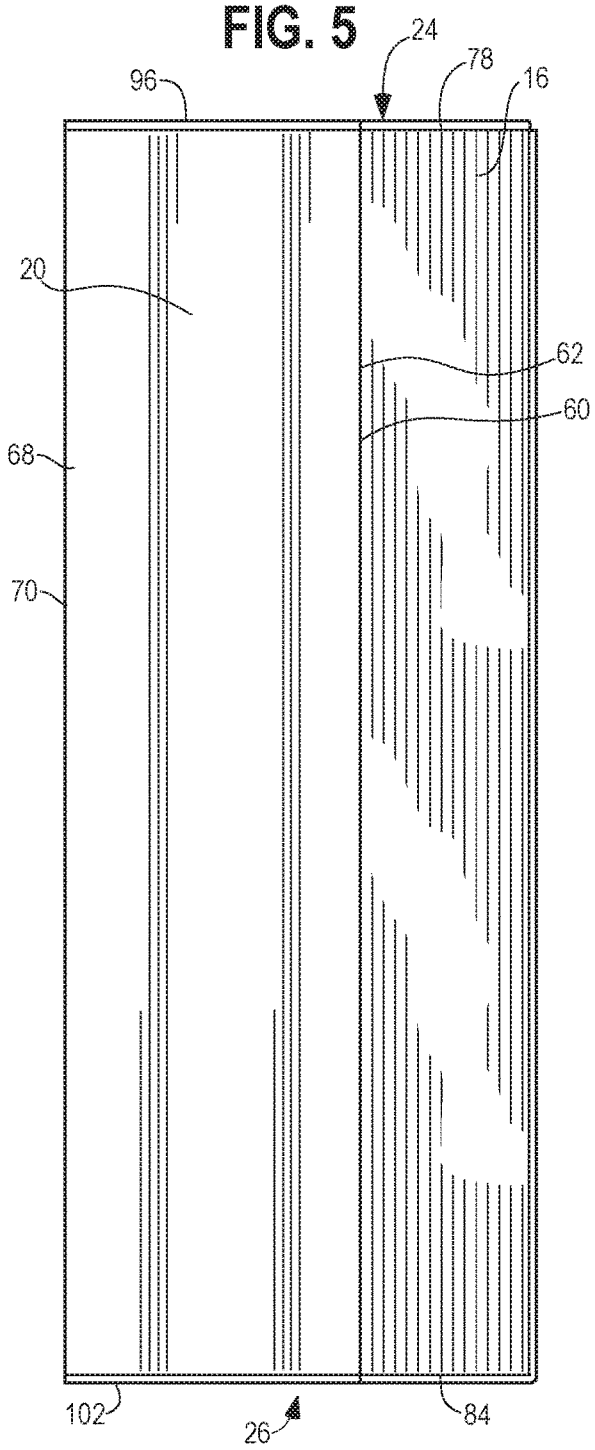
FIG. 5 is a first side elevational view of the eye shield dispenser shown in FIG. 1.
Figure 6:
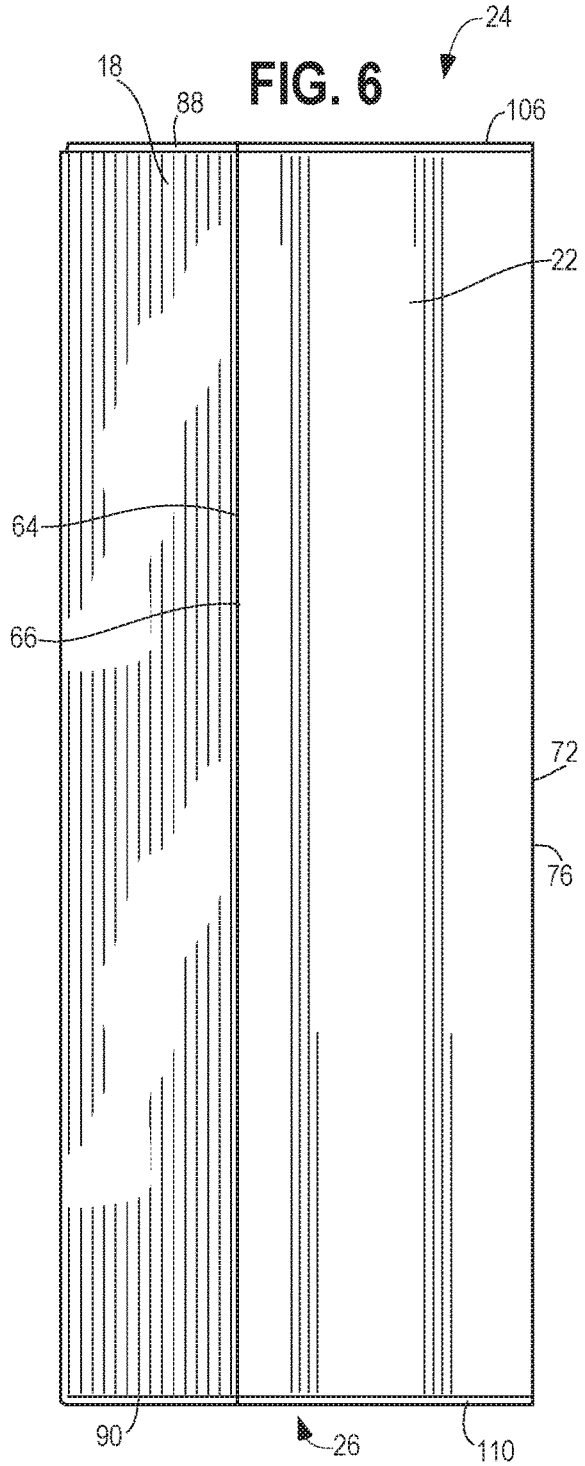
FIG. 6 is a second side elevational view of the eye shield dispenser shown in FIG. 1.
Figure 7:
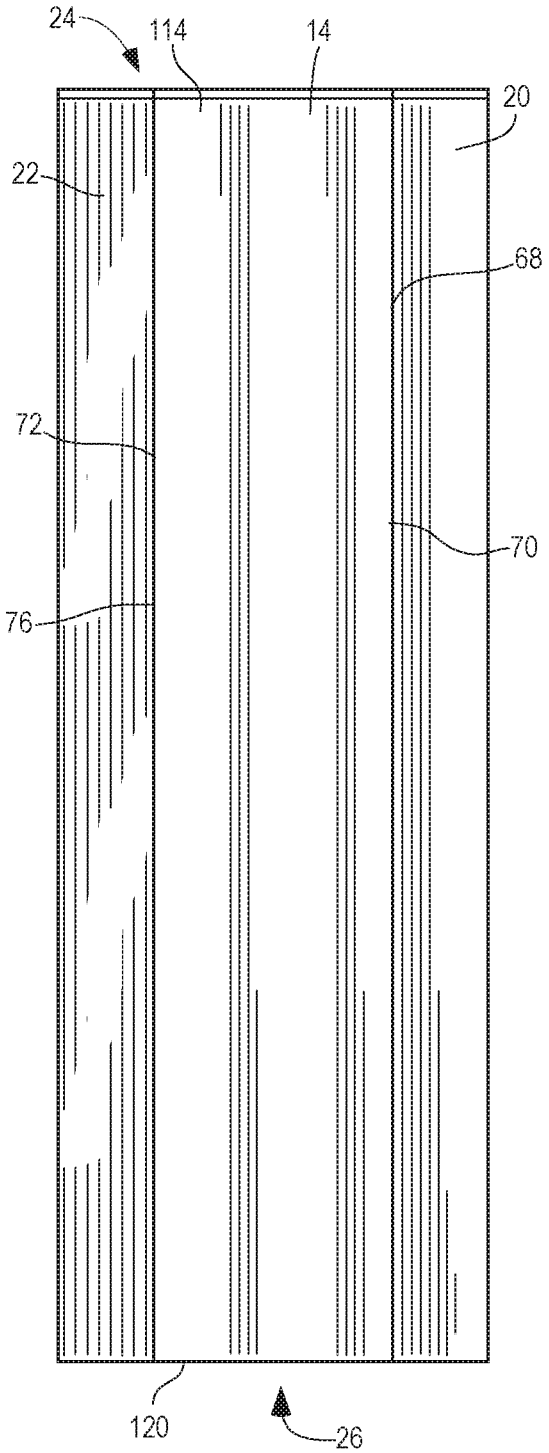
FIG. 7 is a rear elevation view of the eye shield dispenser shown in FIG. 1.

As shown in FIGS. 5 and 6, the first rear side panel 20 is joined to the first front side panel 16 at a first front side panel first side edge 60 along a fifth fold line 62, and the second rear side panel 22 is joined to the second front side panel 18 at a second front side panel first side edge 64 along a sixth fold line 66. The rear panel 14 is joined to the first rear side panel 20 at a first rear side panel first side edge 68 along a seventh fold line 70. In other embodiments, the rear panel 14 may be joined to the second rear side panel 22 at a second rear side panel first side edge 72.

Figure 16:
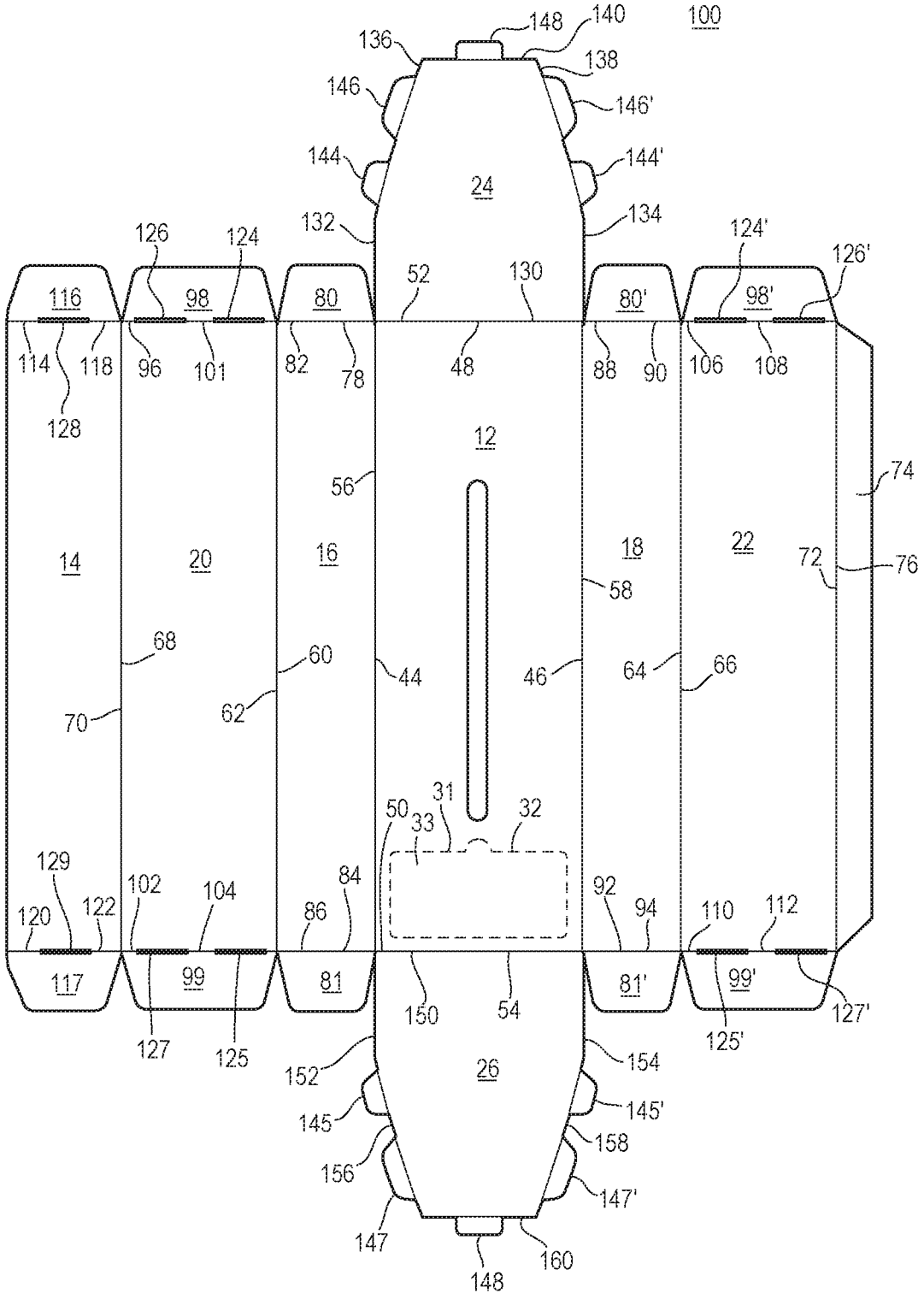
FIG. 16 is a plan view of a blank foldable to form the eye shield dispenser of FIG. 1.

In the illustrated embodiment, the second rear side panel 22 is joined to an attachment flap 74 at the second rear side panel first side edge 72 along an eighth fold line 76. The attachment flap 74 is shown in FIG. 16 showing the blank 100. The attachment flap 74 may be affixed to, for example, the rear portion 14 using an adhesive such as glue, tape, or the like for maintaining the assembly of the dispenser 10.

Figure 10:
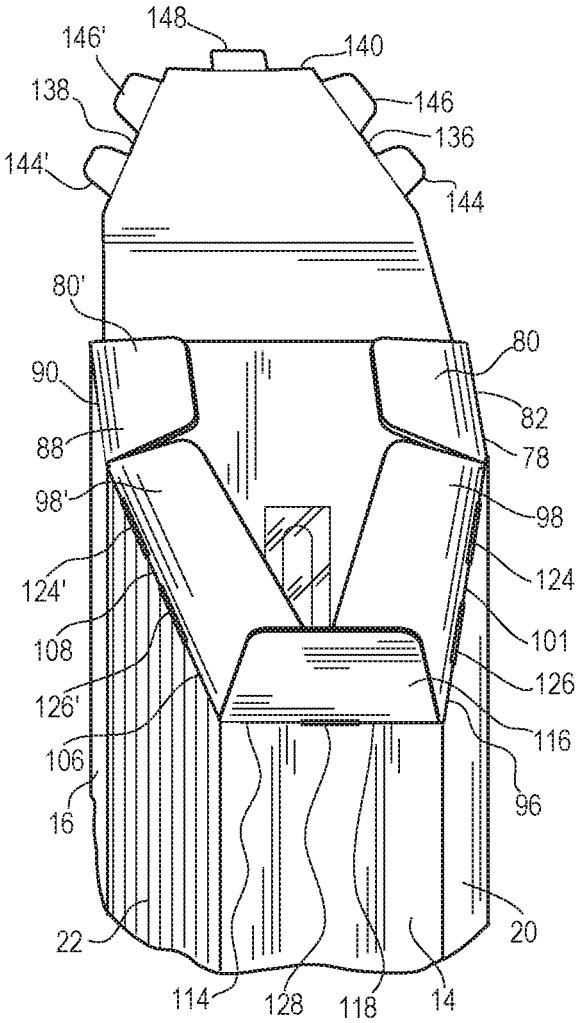
FIG. 10 is a perspective view taken from the rear of the eye shield dispenser shown in FIG. 1 with the top panel opened showing the interior of the dispenser.

Each of the panels of the dispenser 10 may additionally include at least one flap portion configured to receive a corresponding tab for locking insertion to maintain the assembly of the dispenser 10 as shown in, for example, FIG. 10. In the illustrated embodiment, a first front side panel top edge 78 is attached to a first flap portion 80 along a ninth fold line 82 and a first front side panel bottom edge 84 is attached to a second flap portion 81 along a tenth fold line 86. Likewise, a second front side panel top edge 88 is attached to a first flap portion 80' along an eleventh fold line 90 and a second front side panel bottom edge 92 is also attached to a second flap portion 81' along a twelfth fold line 94. A first rear side panel top edge 96 is attached to a third flap portion 98 along a thirteenth fold line 101 and a first rear side panel bottom edge 102 is also attached to a fourth flap portion 99 along a fourteenth fold line 104. Similarly, a second rear side panel top edge 106 is attached to a third flap portion 98' along a fifteenth fold line 108 and a second rear side panel bottom edge 110 is attached to a fourth flap portion 99' along a sixteenth fold line 112. A rear panel top edge 114 is attached to a fifth flap portion 116 along a seventeenth fold line 118 and a rear panel bottom edge 120 is attached to a sixth flap portion 117 along an eighteenth fold line 122.

Each of the flap portions 80, 80', 81, 81', 98, 98', 99, 99', 116 and 117 may include at least one slot extending at least partially along the fold line associated therewith. For example, in the illustrated embodiment shown in FIGS. 10 and 17, third flap portion 98 includes slots 124, 126 extending along the thirteenth fold line 101. Additionally, third flap portion 98' includes slots 124', 126' extending along the fifteenth fold line 108. Similarly, the fourth flap portion 99 includes slots 125, 127 extending along the fourteenth fold line 104. The fourth flap portion 99' includes slots 125', 127' extending along the sixteenth fold line 112. Additionally, the fifth flap portion 116 includes a slot 128 along the seventeenth fold line 118 and the sixth flap portion 117 includes a slot 129 along the eighteenth fold line 122.

Figure 8:
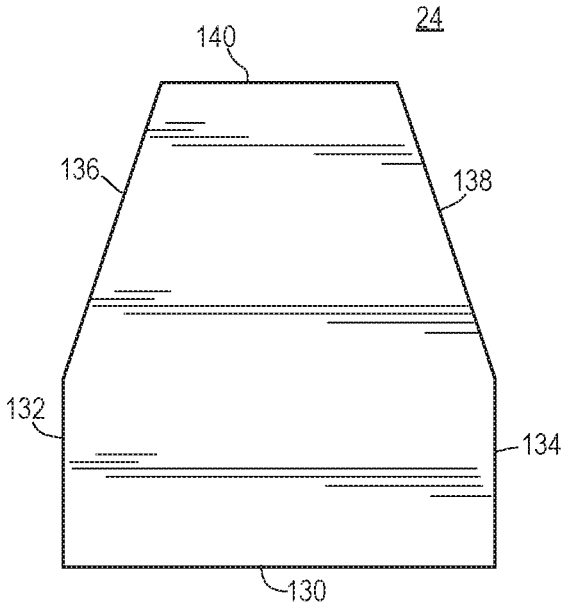
FIG. 8 is top plan view of the eye shield dispenser shown in FIG. 1.

FIG. 8 shows the top panel 24 having a top panel front edge 130, top panel first and second front side edges 132, 134, top panel first and second rear side edges 136, 138 and a top panel rear edge 140. Each of the top panel first and second front side edges 132, 134, top panel first and second rear side edges 136, 138, and the top panel rear edge 140 may include at least one tab. In the illustrated embodiment as shown in FIG. 10, the top panel first rear side edge 136 includes a first tab 144 and a second tab 146, the first tab 144 configured for locking insertion in slot 124 and the second tab 146 configured for locking insertion in slot 126. The top panel second rear side edge 138 includes a first tab 144' and a second tab 146', the first tab 144' configured for locking insertion in slot 124' and the second tab 146' configured for locking insertion in slot 126'. The top panel rear edge 140 includes a third tab 148 configured for locking insertion in slot 128. So configured, the tabs 144, 146, 144', 146' of the top panel 24 are lockingly inserted in slots 124, 126, 124', 126' respectively to maintain the assembly of the dispenser 10. Alternatively, the top panel 24 may include at least one flap portion and the first and second front side panels top edges 78, 88, first and second rear side panels top edges 96, 106 and the rear panel top edge 114 may each include a tab configured for locking insertion in the at least one flap portion of the top panel 24.

Figure 9:
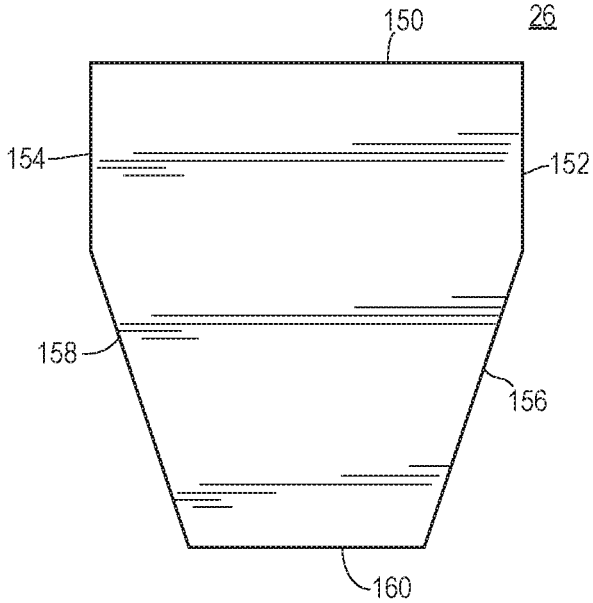
FIG. 9 is a bottom plan view of the eye shield dispenser shown in FIG. 1.

In the illustrated embodiment, the bottom panel 26 is structured similarly to the top panel 24. FIG. 9 shows the bottom panel 26 having a bottom panel front edge 150, bottom panel first and second front side edges 152, 154, bottom panel first and second rear side edges 156, 158 and a bottom panel rear edge 160. Each of the bottom panel first and second front side edges 152, 154, bottom panel first and second rear side edges 156, 158, and the bottom panel rear edge 160 may include at least one tab. For example, in the illustrated embodiment as shown with reference to blank 100 of FIG. 16, the bottom panel first rear side edge 156 includes a first tab 145 and a second tab 147, the first tab 145 configured for locking insertion in slot 125 and the second tab 147 configured for locking insertion in slot 127. Additionally, the bottom panel second rear side edge 158 includes a first tab 145' and a second tab 147', the first tab 145' configured for locking insertion in slot 125' and the second tab 147' configured for locking insertion in slot 127'.

The bottom panel rear edge 160 includes a third tab 148 configured for locking insertion in slot 129. So configured, the tabs 145, 147, 145', 147' of the bottom panel 26 are lockingly inserted in slots 125, 127, 125', 127' respectively to maintain the assembly of the dispenser 10. Alternatively, the bottom panel 24 may include at least one flap and the first and second front side panels bottom edges 84, 92, first and second rear side panels bottom edges 102, 110 and the rear panel bottom edge 120 may each include a tab configured for locking insertion in the at least one flap of the bottom panel 24.

Figure 11:
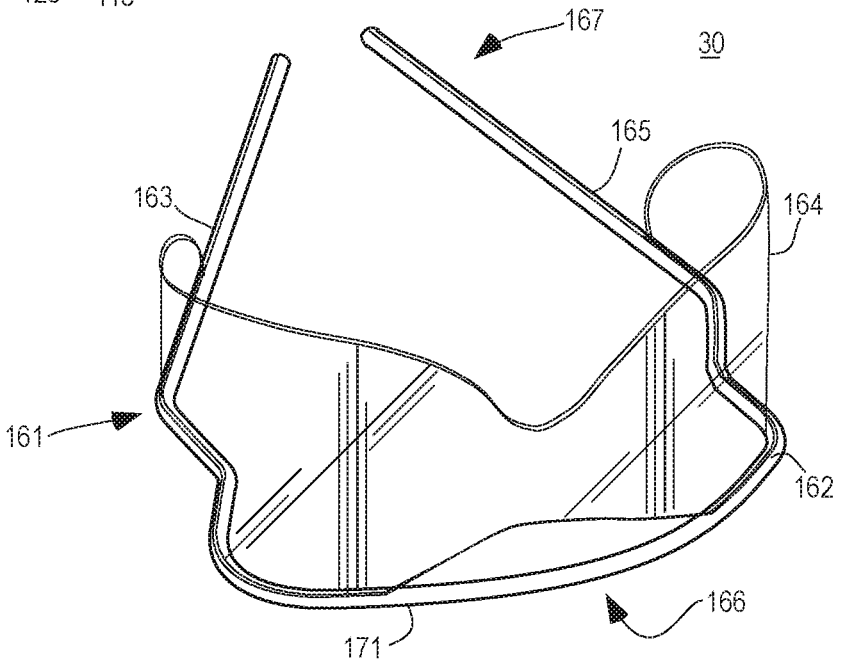
FIG. 11 is a perspective view of an eye shield.

In the illustrated and preferable embodiment, the dispenser 10 is folded into a tower shape with an irregular hexagonal cross-section, as seen in FIGS. 1, 8 and 9. This shape is intended generally to correspond with and accommodate a plurality of eye shields 30. Exemplary eye shields 30 are shown in more detail in FIG. 11. As shown, the eye shields 30 typically include a frame portion 162 and a fluid barrier portion 164. The frame portion 162 is superior to the fluid barrier portion 164 in ordinary use. The eye shields 30 include temple portions 163, 165 that generally taper rearwardly, and which are structured such that the eye shields 30 have a wide front region 166, a slightly wider intermediate region 161, and a narrower rear region 167. The frame material of the eye shields 30 is typically a flexible elastomeric plastic such that the temple portions 163, 165 are caused to grip onto the face of a user to hold the eye shields 30 in place during use.

Returning to FIGS. 5 and 6, the first and second front side panels 16, 18 have a width that is less than a width of the first and second rear side panels 20, 22 to roughly match the shape of the eye shields 30. Additionally, the front panel 12 has a width that is greater than a width of the rear panel 14. So configured, the first and second front side panels 16, 18 extend parallel to one another and outward from the front panel 12. The first and second rear side panels 20, 22 extend from the first and second front side panels 16, 18 respectively and converge towards the rear panel 14.

The top panel 24 and the bottom panel 26 are preferably generally shaped to correspond with the irregular hexagonal shape formed by the front panel 12, the rear panel 14, the first and second front side panels 16, 18, and the first and second rear side panels 20, 22. Specifically, the top panel first and second front side edges 132, 134 and the bottom panel first and second front side edges 152, 154 have widths that substantially correspond with the width of the first and second front side panels 16, 18. The top panel first and second rear side edges 136, 138 and the bottom panel first and second rear side edges 156, 158 likewise have widths that substantially correspond with the width of the first and second rear side panels 20, 22. The top panel front edge 130 and the bottom panel front edge 150 each have a width that substantially corresponds with the width of the front panel 12 and the top panel rear edge 140 and the bottom panel rear edge 160 each have a width that substantially corresponds with the width of the rear panel 14.

Figure 12:
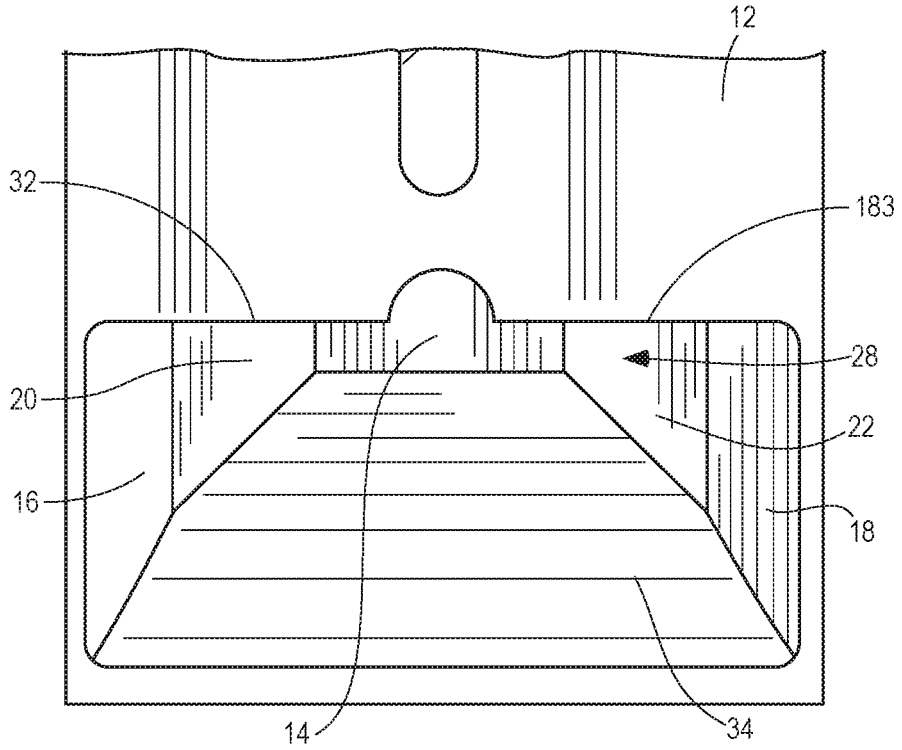
FIG. 12 is an enlarged front elevational view of the eye shield dispenser of FIG. 1 illustrating the access port and an inclined surface in the interior.
Figure 13:
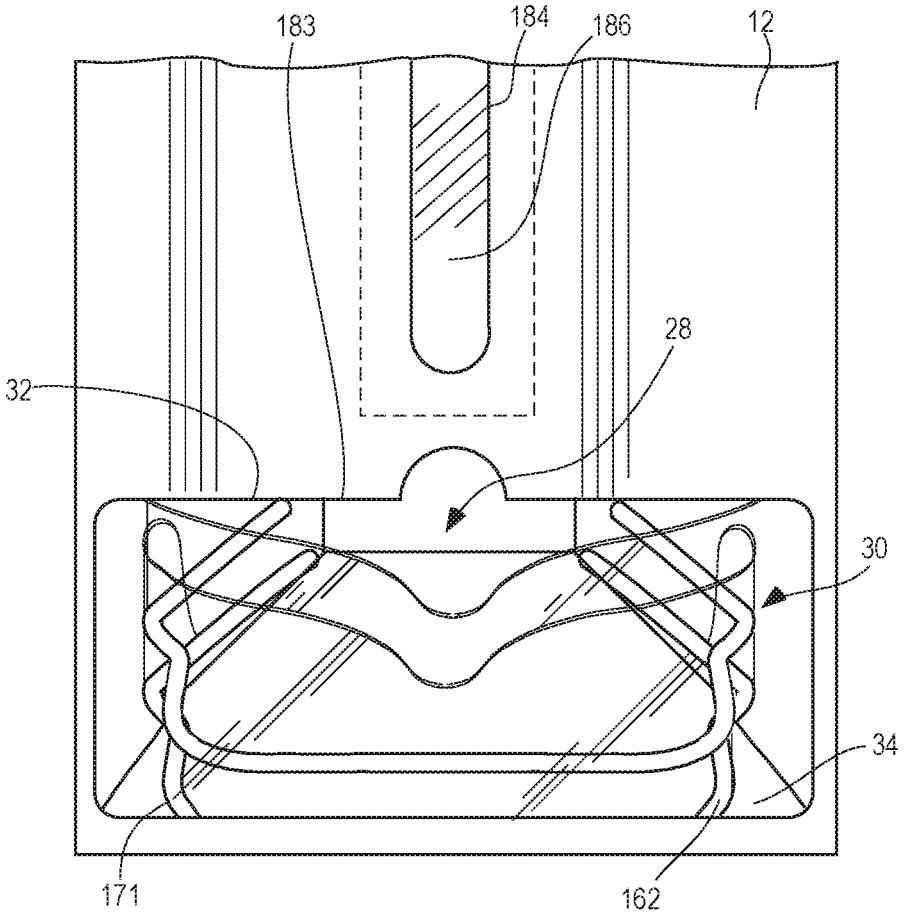
FIG. 13 is a view of the eye shield dispenser similar to FIG. 12 with eye shields disposed on the inclined surface.
Figure 14:
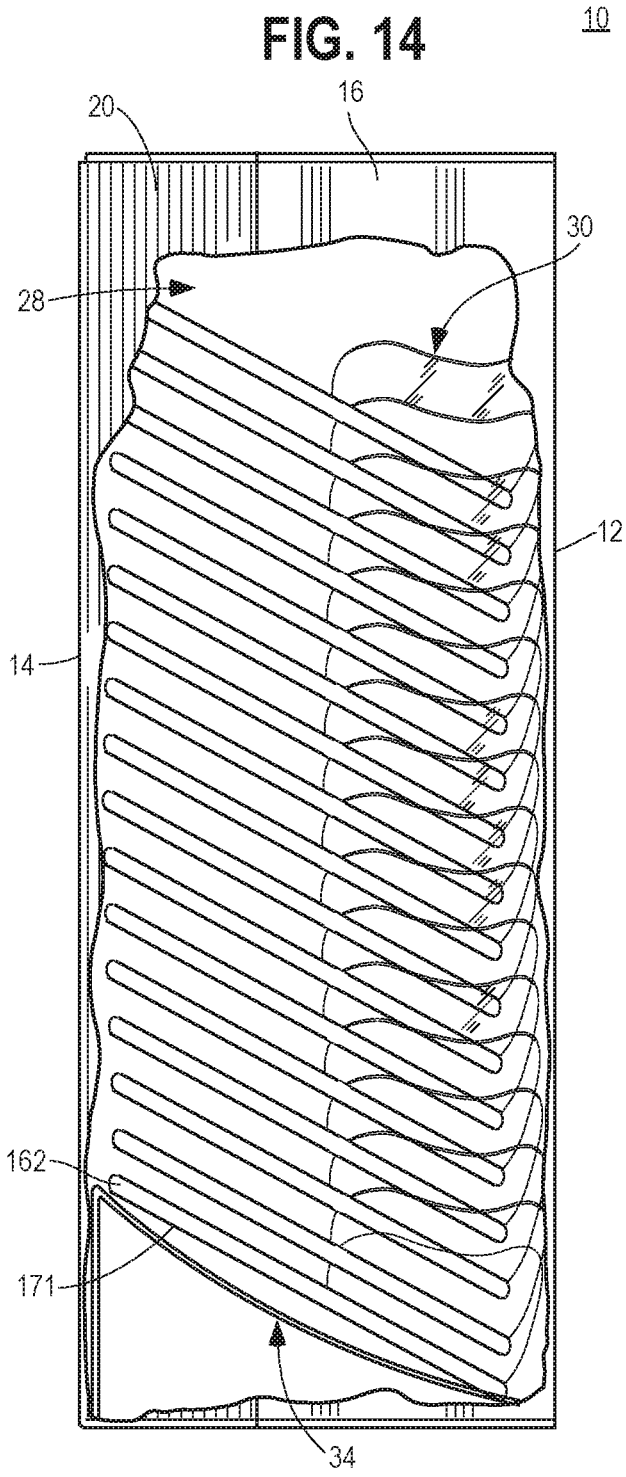
FIG. 14 is a first side cut-away view of the eye shield dispenser of FIG. 1 showing the eye shields stacked within the interior of the dispenser.

So configured, a horizontal cross-section along a lateral axis of the dispenser 10 is shaped to generally correspond with, and accommodate, a plurality of eye shields 30 such that the eye shields 30 may be stacked inside the dispenser 10. FIG. 12 shows an embodiment of the dispenser 10 before accepting any eye shields 30. Preferably, the eye shields 30 are disposed in the dispenser 10 in an upside-down configuration, i.e., such that an upper side 171 of the frame portion 162 contacts and rests on the inclined surface 34 as shown in FIG. 13 or on the bottom panel 26. The eye shields 30 are stacked within the dispenser 10 such that when an eye shield 30 is removed via the access port 32, another eye shield 30 will be gravity-fed into substantially the same place as the removed eye shield 30 for subsequent removal.

Figure 15:
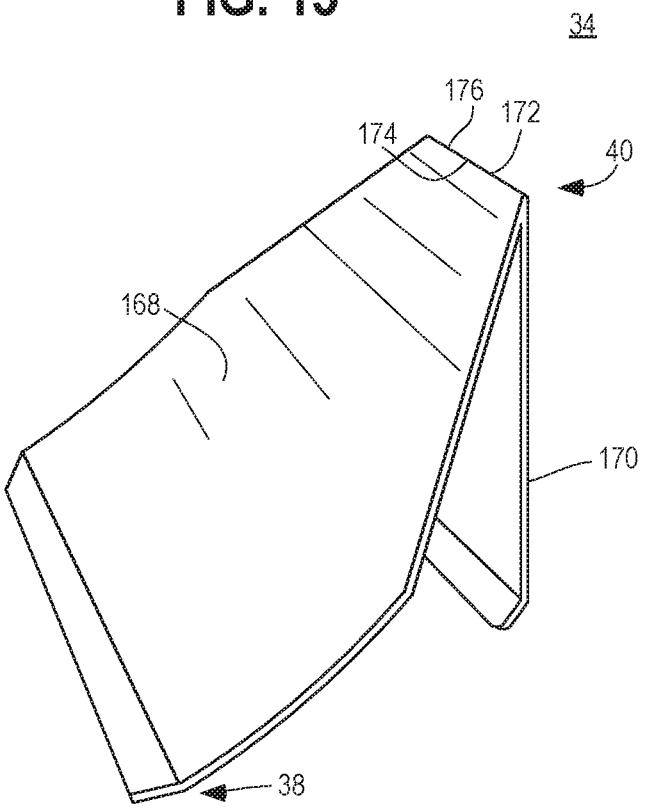
FIG. 15 is a perspective view of the separate inclined surface panel of the eye shield dispenser shown in FIG. 1.

As described above, the optional inclined surface 34 may be disposed in the interior 28 of the dispenser 10. As seen in FIG. 15, the inclined surface 34 preferably extends from a first, lower height 38 near the front panel 12, to a second, higher height 40 near the rear panel 14, such that the inclined surface 34 extends therebetween at an angle. In some embodiments, the inclined surface 34 may be formed of a separate blank 42 to be folded and inserted into the interior 28 once the blank comprising the front panel 12, rear panel 14, first and second front side panels 16, 18, first and second rear side panels 20, 22, top panel 24, and bottom panel 26 is assembled. As shown in FIG. 17, the separate blank 42 for forming the inclined surface 34 may include an inclined panel 168 and a support panel 170, the support panel 170 having a front edge 172 that is connected to a rear edge 174 of the inclined panel 168 along a nineteenth fold line 176. The support panel 170 is configured to be positioned against the rear panel 14, and may be affixed thereto, to support the rear edge 174 of the inclined panel 168 at the second height 40. A front edge 178 of the inclined panel 168 may be attached to a portion of the bottom panel 26 or the front panel 12 at the first height 38 near the access port 32 such that the eye shields 30 resting on the inclined panel 168 may be removed from the interior 28. As illustrated, the inclined panel 168 is shaped to generally correspond with the shape of the dispenser 10. In other embodiments, the blank 42 may be integral with the blank 100 for forming the dispenser 10 such that the dispenser 10 and the inclined surface 34 are foldable from a single sheet of material. In still other embodiments, the inclined surface 34 may be of a solid configuration such as, for example, a molded component to be placed in the dispenser 10.

The access port 32 of the front panel 12 is shown in FIGS. 12 and 13. In the illustrated embodiment, the access port 32 comprises a removable access panel 33 to provide access to the interior 28 of the dispenser 10. FIG. 2 shows the access panel 33 of the front panel 12 before being removed by a user. The removable access panel 33 may be defined by perforations 31 in the front panel 12 to facilitate removal thereof. The removable access panel 33 may include a finger slot 182 such that a user may insert a finger or similarly sized instrument to pull out and remove the perforated removable access panel 33 to access the interior 28 of the dispenser 10. The finger slot 182 may be located near the access port 32 for example, on an upper side 183 thereof. In still other embodiments, the access port 32 may comprise an aperture of the front panel 12.

The front panel 12 may additionally include a slot 184 extending along a longitudinal direction L between the front panel top edge 48 and the front panel bottom edge 50. The slot 184 provides visual access to the interior 28 of the dispenser 10 for a user to determine how many eye shields 30 remain within the dispenser 10. The front panel 12 may further include a transparent or substantially transparent window or film 186 attached to the front panel 12 and covering the slot 184 to inhibit particles or contaminants from entering the interior 28 of the dispenser 10 by the slot 184. The window 186 may be attached on the front panel 12 via an adhesive such as glue, tape, or the like.

The blank 100 for forming a dispenser 10 is further provided in FIG. 16. As depicted in FIG. 16, the blank 100 includes the front panel 12, rear panel 14, first front side panel 16, second front side panel 18, first rear side panel 20, second rear side panel 22, top panel 24 and the bottom panel 26. The front panel 12 additionally includes the access port 32 that may be formed as the removable access panel 33 defined by perforations 31 of the front panel 12.

The front panel first side edge 44, the front panel second side edge 46, the front panel top edge 48, and the front panel bottom edge 50 are shown. The front panel 12 is joined to the top panel 24 at the front panel top edge 48 along the first fold line 52 and joined to the bottom panel 26 at the front panel bottom edge 38 along the second fold line 54. The front panel 12 is joined to the first front side panel 16 at the front panel first side edge 44 along the third fold line 56 and the second front side panel 18 at the front panel second side edge 46 along the fourth fold line 58. This configuration is not critical and the panels may be joined to other panels at different fold lines in other embodiments.

The first rear side panel 20 is joined to the first front side panel 16 at the first front side panel first side edge 60 along the fifth fold line 62, and the second rear side panel 22 is joined to the second front side panel 18 at the second front side panel first side edge 64 along the sixth fold line 66. The rear panel 14 is joined to the first rear side panel 20 at the first rear side panel first side edge 68 along the seventh fold line 70. In the illustrated embodiment, the second rear side panel 22 is joined to the attachment flap 74 at the second rear side panel first side edge 72 along the eighth fold line 76.

The first front side panel top edge 78 is attached to the first flap portion 80 along the ninth fold line 82 and the first front side panel bottom edge 84 is attached to the second flap portion 81 along the tenth fold line 86. Likewise, the second front side panel top edge 88 is attached to the first flap portion 80' along the eleventh fold line 90 and the second front side panel bottom edge 92 is also attached to the second flap portion 81' along a twelfth fold line 94. The first rear side panel top edge 96 is attached to the third flap portion 98 along the thirteenth fold line 101 and the first rear side panel bottom edge 102 is attached to the fourth flap portion 99 along the fourteenth fold line 104. Similarly, the second rear side panel top edge 106 is attached to the third flap portion 98' along the fifteenth fold line 108 and the second rear side panel bottom edge 110 is attached to the fourth flap portion 99' along the sixteenth fold line 112. The rear panel top edge 114 is attached to the fifth flap portion 116 along the seventeenth fold line 118 and the rear panel bottom edge 120 is attached to the sixth flap portion 117 along the eighteenth fold line 122.

As shown the third flap portion 98 includes slots 124, 126 extending along the thirteenth fold line 101, and the third flap portion 98' includes slots 124', 126' extending along the fifteenth fold line 108. Similarly, the fourth flap portion 99 includes slots 125, 127 extending along the fourteenth fold line 104, and the fourth flap portion 99' includes slots 125', 127' extending along the sixteenth fold line 112. Additionally, the fifth flap portion 116 includes the slot 128 along the seventeenth fold line 118 and the sixth flap portion 117 includes the slot 129 along the eighteenth fold line 122.

As shown in FIG. 16, the top panel first rear side edge 136 includes the first tab 144 and the second tab 146. The top panel second rear side edge 138 includes the first tab 144' and the second tab 146'. The top panel rear edge 140 includes the third tab 148.

In the illustrated embodiment, the bottom panel 26 is structured similarly to the top panel 24. The bottom panel first rear side edge 156 includes the first tab 145 and the second tab 147. Additionally, the bottom panel second rear side edge 158 includes the first tab 145' and the second tab 147'. The bottom panel rear edge 160 includes the third tab 148.

As described above, and shown in FIG. 16, the first and second front side panels 16, 18 have a width that is less than a width of the first and second rear side panels 20, 22. Additionally, the front panel 12 has a width that is greater than a width of the rear panel 14. The top panel first and second front side edges 132, 134 and the bottom panel first and second front side edges 152, 154 have widths that substantially correspond with the width of the first and second front side panels 16, 18. The top panel first and second rear side edges 136, 138 and the bottom panel first and second rear side edges 156, 158 likewise have widths that substantially correspond with the width of the first and second rear side panels 20, 22. The top panel front edge 130 and the bottom panel front edge 150 each have a width that substantially corresponds with the width of the front panel 12 and the top panel rear edge 140 and the bottom panel rear edge 160 each have a width that substantially corresponds with the width of the rear panel 14.

Additionally, as shown in FIG. 17, the separate blank 42 is foldable to form the inclined surface 34 of FIG. 15. As described above with respect to FIG. 15, the blank 42 may include the inclined panel 168 and the support panel 170. As illustrated, the inclined panel 168 is shaped to generally correspond with the shape of the top and bottom panels 24, 26.

In another embodiment, a blank 100' is provided that is formed similar to blank 100 such that any differences will be described below. The blank 100' may not include a third tab 148' at a bottom panel rear edge 160'. Alternatively, the bottom panel rear edge 160' may be attached to an inclined surface 34' at a rear edge 173' of a support panel 170' thereof along a twentieth fold line 190'. So configured a dispenser having a front panel 12', a rear panel 14', a first front side panel 16', a second front side panel 18', a first rear side panel 20', a second rear side panel 22', a top panel 24', a bottom panel 26' and the inclined surface 34' may be formed by folding the blank 100'.

Uses of singular terms such as "a," "an," are intended to cover both the singular and the plural, unless otherwise indicated herein or clearly contradicted by context. The terms "comprising," "having," "including," and "containing" are to be construed as open-ended terms. Any description of certain embodiments as "preferred" embodiments, and other recitation of embodiments, features, or ranges as being preferred, or suggestion that such are preferred, is not deemed to be limiting. The invention is deemed to encompass embodiments that are presently deemed to be less preferred and that may be described herein as such. All methods described herein can be performed in any suitable order unless otherwise indicated herein or otherwise clearly contradicted by context. The use of any and all examples, or exemplary language (e.g., "such as") provided herein, is intended to illuminate the invention and does not pose a limitation on the scope of the invention. Any statement herein as to the nature or benefits of the invention or of the preferred embodiments is not intended to be limiting. This invention includes all modifications and equivalents of the subject matter recited herein as permitted by applicable law. Moreover, any combination of the above-described elements in all possible variations thereof is encompassed by the invention unless otherwise indicated herein or otherwise clearly contradicted by context. No unclaimed language should be deemed to limit the invention in scope. Any statements or suggestions herein that certain features constitute a component of the claimed invention are not intended to be limiting unless reflected in the appended claims. Neither the marking of the patent number on any product nor the identification of the patent number in connection with any service should be deemed a representation that all embodiments described herein are incorporated into such product or service.

What is claimed is:

1. A dispenser for eye shields comprising:

a front panel, a rear panel, first and second front side panels, first and second rear side panels, a top panel, and a bottom panel, the front panel, rear panel, first and second front side panels, first and second rear side panels, the top panel, and the bottom panel defining an interior for containing eye shields;

the front panel having first and second front panel side edges and joined to the first and second front side panels at the first and second front panel side edges respectively;

the front panel having a front panel top edge joined to a top panel front edge and a front panel bottom edge joined to a bottom panel front edge;

the first rear side panel joined to the first front side panel at a first front side panel first side edge, and the second rear side panel joined to the second front side panel at a second front side panel first side edge;

the rear panel joined to the first rear side panel at a first rear side panel first side edge;

the second rear side panel having an attachment flap joined at a second rear side panel first side edge, the attachment flap connected to the rear panel;

the top panel further including top panel first and second front side edges, top panel first and second rear side edges, and a top panel rear edge;

the bottom panel further including bottom panel first and second front side edges, bottom panel first and second rear side edges, and a bottom panel rear edge;

the front panel further including an access port, the access port comprising at least one of a removable access panel or aperture proximal the bottom panel for providing access to the interior of the dispenser.

2. The dispenser of claim 1, wherein the dispenser does not include an insert in the interior, and the bottom panel extends between the front panel and the rear panel from a first height proximal the front panel to a second height proximal the rear panel, the second height higher than the first height.

3. The dispenser of claim 1 further comprising an inclined surface disposed proximal the access port in the interior of the dispenser.

4. The dispenser of claim 3 wherein the inclined surface extends between the front panel and the rear panel from a first height proximal the front panel to a second height proximal the rear panel, the second height higher than the first height.

5. A kit comprising the dispenser of claim 3 and at least one eye shield disposed on the inclined surface in the interior of the dispenser.

6. A kit comprising the dispenser of claim 3 and a plurality of eye shields disposed on the inclined surface in the interior of the dispenser.

7. The kit of claim 6 wherein the plurality of eye shields each comprise a frame portion and an eye barrier portion, each eye shield resting on its frame portion.

8. The dispenser of claim 1 wherein the front panel further includes a frontal, longitudinal slot extending at least partially between the front panel top and bottom edges.

9. The dispenser of claim 8 further including a window covering said slot.

10. The dispenser of claim 1 wherein the first and second front side panels each have a top edge and a bottom edge, the first and second front side panel top edges each joined to a first flap portion and the first and second front side panel bottom edges each joined to a second flap portion;

the first and second rear side panels each have a top edge and a bottom edge, the first and second rear side panel top edges each joined to a third flap portion and the first and second rear side panel bottom edges each joined to a fourth flap portion;

the rear panel having a rear panel top edge and a rear panel bottom edge, the rear panel top edge joined to a fifth flap portion and the rear panel bottom edge joined to a sixth flap portion.

11. The dispenser of claim 10 wherein the top panel first and second rear side edges and the bottom panel first and second rear side edges each include at least one tab, the top panel rear edge and bottom panel rear edge each include a tab portion; and the third, fourth, fifth and sixth flap portions each including at least one slot, each slot configured for locking insertion of at least one tab of the top and bottom panels.

12. The dispenser of claim 3, wherein the front panel, rear panel, first and second front side panels, first and second rear side panels, the top panel, and the bottom panel are folded from a single sheet of material.

13. The dispenser of claim 12, including an inclined surface formed of a separate sheet of material.

14. The dispenser of claim 12, including an inclined surface folded from the single sheet of material.

15. The dispenser of claim 1 wherein the first and second front side panels have a width, the first and second rear side panels have a width, the width of the first and second rear side panels each being greater than the width of the first and second front side panels.

16. The dispenser of claim 15 wherein the front panel has a width, and the rear panel has a width, the width of the front panel being greater than the width of the rear panel.

17. The dispenser of claim 16 wherein the top and bottom panel first and second front side edges have a width that is substantially the same as the width of the first and second front side panels, and the top and bottom panel first and second rear side edges have a width that is substantially the same as the width of the first and second rear side panels.

18. The dispenser of claim 1 wherein the access port comprises a perforated removable access panel.

19. The dispenser of claim 18 wherein the perforated removable access panel further includes a finger slot.

20. A blank for forming an eye shield dispenser, the blank comprising:

a front panel attached to a top panel at a front panel top edge along a first fold line and a bottom panel at a front panel bottom edge along a second fold line;

the front panel attached to a first front side panel at a front panel first side edge along a third fold line and a second front side panel at a front panel second side edge along a fourth fold line;

the first front side panel attached to a first rear side panel at a first front side panel first side edge along a fifth fold line, and the second front side panel attached to a second rear side panel at a second front side panel first side edge along a sixth fold line;

the first rear side panel attached to a rear panel at a first rear side panel first side edge along a seventh fold line, and the second rear side panel attached to an attachment flap at a second rear side panel first side edge along an eighth fold line;

wherein the top panel includes a top panel front edge, top panel first and second side front side edges, top panel first and second rear side edges, and a top panel rear edge;

wherein the bottom panel includes a bottom panel front edge, bottom panel first and second front side edges, bottom panel first and second rear side edges, and a bottom panel rear edge;

the front panel further including an access port, the access port comprising a removable access panel proximal the front panel bottom edge.

21. The blank of claim 20 wherein perforations of the front panel define the removable access panel.

22. The blank of claim 20 wherein:

the first and second front side panels each include a top edge, the first front side panel top edge and the second front side panel top edge each attached to a first flap portion along a ninth fold line and an eleventh fold line respectively;

the first and second front side panels each include a bottom edge, the first front side panel bottom edge and the second front side panel bottom edge each attached to a second flap portion along a tenth fold line and twelfth fold line respectively;

the first and second rear side panel each include a top edge, the first rear side panel top edge and the second rear side panel top edge each attached to a third flap portion along a thirteenth and fifteenth fold line respectively;

the first and second rear side panel each include a bottom edge, the first rear side panel bottom edge and the second rear side panel bottom edge each attached to a third flap portion along a fourteenth and sixteenth fold line respectively;

the rear panel including a top edge and a bottom edge, the rear panel top edge attached to a fifth flap portion along a seventeenth fold line and the rear panel bottom edge attached to a sixth flap portion along an eighteenth fold line.

23. The blank of claim 20 wherein the front panel further includes a frontal, longitudinal slot extending between the front panel top edge and the front panel bottom edge.

24. The blank of claim 20 further including an inclined surface panel attached to the bottom panel at the bottom panel rear edge.

25. The blank of claim 20 wherein the first and second front side panels have a width, the first and second rear side panels have a width, the width of the first and second rear side panels being greater than the width of the first and second front side panels.

26. The blank of claim 25 wherein the front panel has a width and the rear panel has a width, the width of the front panel being greater than the width of the rear panel.

27. The blank of claim 26 wherein the top and bottom panel first and second front side edges are substantially the same length as the first and second front side panel top and bottom edges respectively, the top and bottom panel first and second rear side edges are substantially the same length as the first and second rear side panel top and bottom edges respectively, and the top and bottom panel rear edges each are substantially the same length as the rear panel top and bottom edges respectively.

28. The blank of claim 22 wherein the top panel first rear side edge is attached to at least one tab, the top panel second rear side edge is attached to at least one tab, and the top panel rear edge is attached to at least one tab;

wherein the bottom panel first rear side edge is attached to at least one tab, the bottom panel second rear side edge is attached to at least one tab, and the bottom panel rear edge is attached to at least one tab; and wherein each of the thirteenth, fourteenth, fifteenth, sixteenth, seventeenth, and eighteenth fold lines include at least one slot, each slot configured to receive at least one tab of the top and bottom panels for locking insertion.

* * * * *